US005389012A

United States Patent [19]

Huang

[11] Patent Number: 5,389,012

[45] Date of Patent: Feb. 14, 1995

[54] COAXIAL CONDUCTOR AND A COAX CONNECTOR THEREOF

[76] Inventor: George Y. Huang, 5th Fl., No. 277-1, Sec. 4, Pa-Te Rd., Taipei City,

[21] Appl. No.: 204,756

[22] Filed: Mar. 2, 1994

[51] Int. Cl.[6] ..... H01R 17/18

[52] U.S. Cl. ..... 439/583; 439/578

[58] Field of Search ..... 439/578, 583, 584, 579, 439/580, 581

[56] References Cited

U.S. PATENT DOCUMENTS

| | | | |
|---|---|---|---|
| 2,870,420 | 1/1959 | Malek | 439/583 X |
| 3,199,061 | 8/1965 | Johnson et al. | 439/583 X |
| 3,622,939 | 11/1971 | Forney, Jr. | 439/583 X |
| 3,665,371 | 5/1972 | Cripps | 439/319 |
| 3,678,447 | 7/1972 | Ziegler, Jr. et al. | 439/583 X |
| 3,808,580 | 4/1974 | Johnson | 439/321 |
| 3,818,420 | 6/1974 | Barr | 439/261 |
| 4,322,121 | 3/1982 | Riches et al. | 439/312 |
| 4,648,683 | 3/1987 | Botka | 439/583 |
| 4,842,553 | 6/1989 | Ingram | 439/583 |
| 4,917,631 | 4/1990 | Souders et al. | 439/583 |
| 5,021,010 | 6/1991 | Wright | 439/578 |
| 5,137,470 | 8/1992 | Doles | 439/578 |
| 5,154,636 | 10/1992 | Vaccaro et al. | 439/583 |

FOREIGN PATENT DOCUMENTS

| | | | |
|---|---|---|---|
| 41419 | 12/1981 | European Pat. Off. | 439/583 |
| 194242 | 2/1965 | Sweden | 439/583 |
| 1282715 | 7/1972 | United Kingdom | 439/583 |
| 2139018 | 10/1984 | United Kingdom | 439/578 |

OTHER PUBLICATIONS

Bunker Ramo Corp Publ. pp. 79–84; publ. Oct. 1980 Harold Hutter & Bruce Ramsland.

*Primary Examiner*—William Briggs
*Attorney, Agent, or Firm*—Marshall & Melhorn

[57] ABSTRACT

A coaxial conductor has a coax connector which includes a tubular outer conductor, an insulator unit and an elongated inner conductor. The tubular outer conductor has a rear end portion, a front end portion and an intermediate portion which is disposed between the rear and front end portions and which confines a through-hole that communicates the rear and front end portions. The rear end portion has a teethed inner wall surface. The through-hole has a diameter smaller than inner diameters of the rear and front end portions, and a diverging end section adjacent to the rear end portion. The insulator unit is disposed fittingly in the front end portion of the tubular outer conductor. The inner conductor has a portion that extends through the insulator unit and into the intermediate portion of the tubular outer conductor, and is retained in an axial direction of the tubular outer conductor by the insulator unit.

6 Claims, 4 Drawing Sheets

COAXIAL CONDUCTOR AND A COAX CONNECTOR THEREOF

BACKGROUND OF THE INVENTION

1. Field of the Invention

The invention relates to a coaxial conductor, more particularly to a coaxial conductor with an improved coax connector which can be attached securely and easily on one end of a coaxial signal cable.

2. Description of the Related Art

Referring to FIG. 1, a conventional mini-DIN coax connector is shown to comprise a tubular outer conductor 1 and a tubular inner conductor 2. The tubular outer conductor 1 has a rear end portion 10 and a front end portion 11. The front end portion 11 is used to connect the coax connector and one end of a coaxial signal cable. The tubular inner conductor 2 is used to connect the coax connector and a conventional socket. The tubular inner conductor 2 has a portion which extends into the front end portion 11 of the tubular outer conductor 1 and which is retained axially within the same by an insulator body 20.

Referring to FIG. 2, a conventional coaxial signal cable 3 is shown to comprise a center conductor 30, a braided outer conductor 31, a dielectric (not shown) which separates the center conductor 30 from the braided outer conductor 31, and an insulating jacket 32 which is provided around the braided outer conductor 31. When mounting the coax connector on one end of the coaxial signal cable 3, it is necessary to strip one end of the insulating jacket 32 so as to expose a portion of the braided outer conductor 31. The exposed portion of the braided outer conductor 31 is then pulled over the insulating jacket 32 so as to expose a portion of the dielectric. The exposed portion of the dielectric is then stripped so as to expose a portion of the center conductor 30. The exposed portion of the center conductor 30 is extended into the tubular inner conductor 2 to effect electrical contact with the same. The exposed portion of the braided outer conductor 31 is in contact with the inner wall surface of the rear end portion 10 of the tubular outer conductor 1, thereby completing the electrical connection between the coax connector and the coaxial signal cable 3. A crimping tool (not shown) is employed so as to crimp the tubular outer conductor 1 onto the coaxial signal cable 3, thereby strengthening the structural connection between the coax connector and the coaxial signal cable 3.

To use the coax connector, the front end portion 11 of the tubular outer conductor 1 is inserted into a conventional socket 4 so as to contact tightly an outer conductive sleeve 41 of the latter. The tubular inner conductor 2 extends fittingly into a through-hole 401 of an inner conductive sleeve 40 of the socket 4 at this stage.

Some of the drawbacks of the conventional mini-DIN coax connector are listed as follows:

1. Attachment of the coax connector to the coaxial signal cable 3 cannot be accomplished easily. Note that the diameter of the tubular inner conductor 2 is relatively small. Thus, extension of the exposed portion of the center conductor 30 into the tubular inner conductor 2 cannot be achieved conveniently. Furthermore, if the center conductor 30 is a stranded conductor, it is likely that several strands of the center conductor 30 will not extend into the tubular inner conductor 2 and will come into contact with the tubular outer conductor 1, thereby resulting in signal interference or in a short-circuit condition.

2. When connecting the coax connector to the socket 4, it is necessary to extend the tubular inner conductor 2 into the inner conductive sleeve 40 of the socket 4. If the coax connector was connected to the socket 4 improperly, the tubular inner conductor 2 might be forced further into the tubular outer conductor 1. This can result in improper electrical contact between the coax connector and the socket 4.

SUMMARY OF THE INVENTION

Therefore, the objective of the present invention is to provide a coaxial conductor with an improved coax connector which can overcome the above mentioned drawbacks that are commonly associated with the prior art.

Accordingly, the coaxial conductor of the present invention comprises a coax connector and a coaxial signal cable. The coax connector includes a tubular outer conductor, an insulator unit, and an elongated inner conductor. The tubular outer conductor has a rear end portion, a front end portion and an intermediate portion which is disposed between the rear and front end portions and which confines a through-hole that communicates the rear and front end portions. The rear end portion has a teethed inner wall surface. The through-hole has a diameter smaller than inner diameters of the rear and front end portions, and a diverging end section adjacent to the rear end portion. The insulator unit is disposed fittingly in the front end portion of the tubular outer conductor. The inner conductor has a portion that extends through the insulator unit and into the intermediate portion of the tubular outer conductor. The inner conductor is retained in an axial direction of the tubular outer conductor by the insulator unit.

The coaxial signal cable includes a center conductor, a braided outer conductor, a dielectric which separates the center conductor from the braided outer conductor, and an insulating jacket which is provided around the braided outer conductor. One end of the insulating jacket is stripped so as to expose a portion of the braided outer conductor. The exposed portion of the braided outer conductor is pulled over the insulating jacket so as to expose a portion of the dielectric. The coaxial signal cable is inserted into the tubular outer conductor via the rear end portion such that the exposed portion of the dielectric extends slidably into the intermediate portion so as to be pierced by the inner conductor in order to establish electrical connection between the center conductor and the inner conductor. The rear end portion of the tubular outer conductor is crimped to permit the teethed inner wall surface to penetrate into the insulating jacket of the coaxial signal cable and to permit electrical contact between the braided outer conductor and the tubular outer conductor.

BRIEF DESCRIPTION OF THE DRAWINGS

Other features and advantages of the present invention will become apparent in the following detailed description of the preferred embodiments, with reference to the accompanying drawings, of which.

DETAILED DESCRIPTION OF THE PREFERRED EMBODIMENTS

Figure 1:
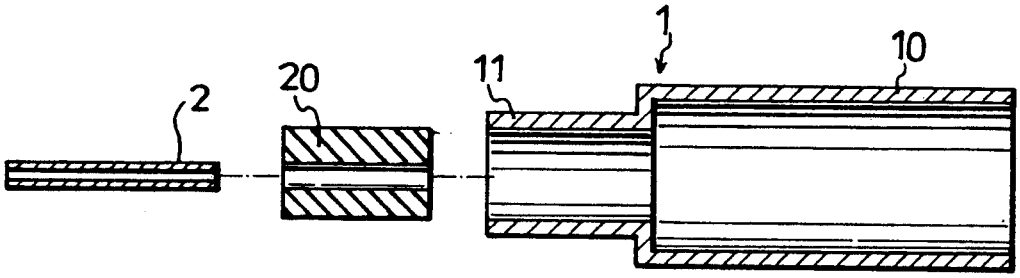
FIG. 1 PRIOR ART
FIG. 1 is an exploded sectional view of a conventional coax connector.
Figure 2:
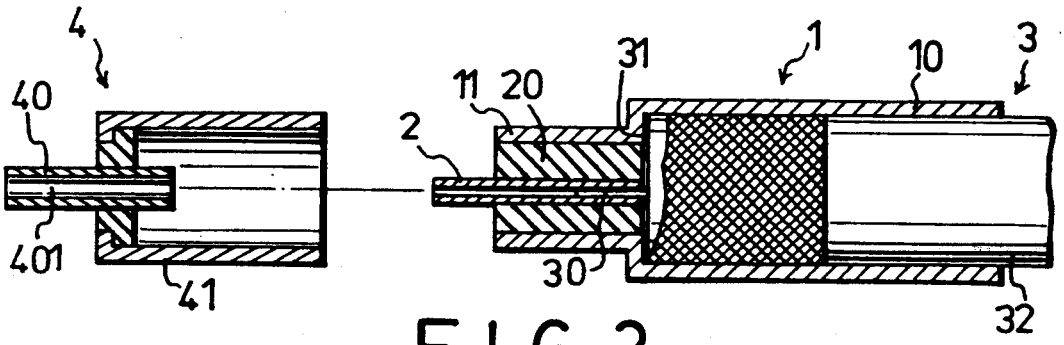
FIG. 2 PRIOR ART
FIG. 2 is a sectional view illustrating a conventional coaxial conductor that includes the coax connector shown in FIG. 1 prior to connection with a conventional socket.
Figure 3:
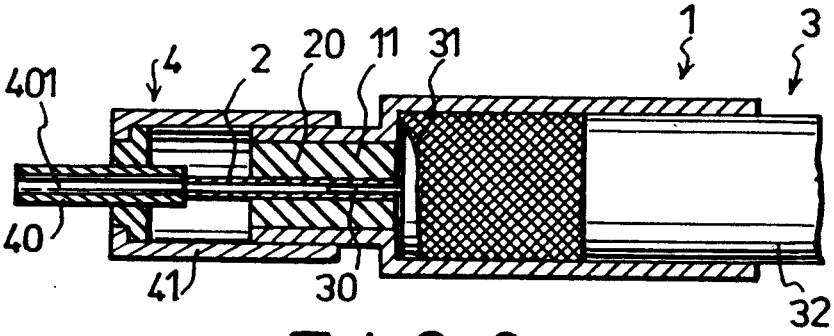
FIG. 3 is a sectional view illustrating the conventional coaxial conductor when connected improperly to the conventional socket.
Figure 4:
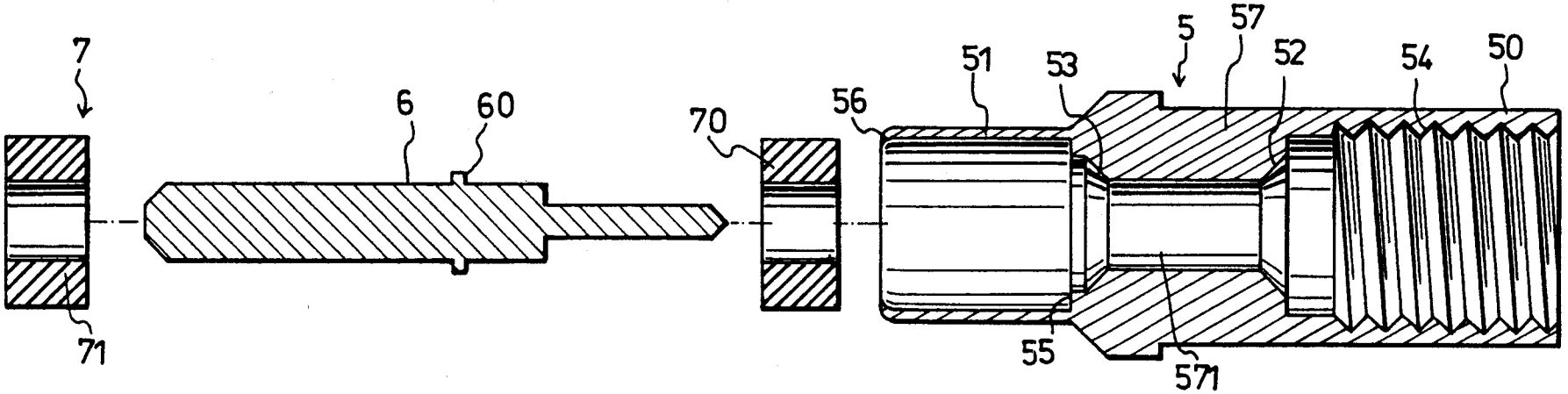
FIG. 4 is an exploded sectional view of the first preferred embodiment of an improved coax connector according to the present invention.
Figure 5:
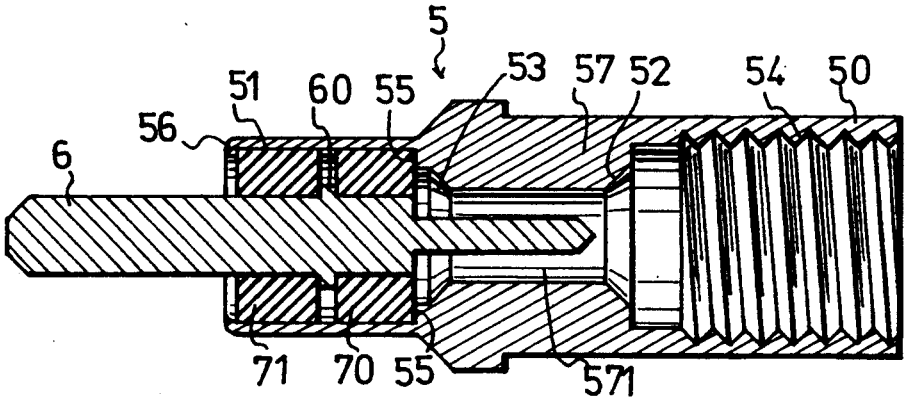
FIG. 5 is a sectional view illustrating the assembly of the coax connector of the first preferred embodiment.

Referring to FIGS. 4 and 5, the first preferred embodiment of an improved coax connector according to the present invention is shown to be configured as a mini-DIN coax connector and comprises a tubular outer conductor 5 and a solid elongated inner conductor 6. The tubular outer conductor 5 includes a rear end portion 50, a front end portion 51 and an intermediate portion 57 which is disposed between the rear and front end portions 50, 51 and which confines a through-hole 571 that communicates the rear and front end portions 50, 51. The through-hole 571 has a diameter that is smaller than the inner diameters of the rear and front end portions 50, 51 and has two diverging end sections 52, 53 that are disposed adjacent to a respective one of the rear and front end portions 50, 51. The rear end portion 50 has a teethed inner wall surface 54. The front end portion 51 is formed with an inwardly projecting shoulder 55 adjacent to the intermediate portion 57. An insulator unit 7 is disposed fittingly in the front end portion 51. The inner conductor 6 is a pin member with a predetermined length and has a portion that extends through the insulator unit 7 and into the front end portion 51 and the intermediate portion 57 of the tubular outer conductor 5. The insulator unit 7 retains the inner conductor 6 in an axial direction of the tubular outer conductor 5. In this embodiment, the insulator unit 7 includes inner and outer insulator rings 70, 71. The inner insulator ring 70 is disposed in the front end portion 51 of the tubular outer conductor 5 and abuts against the shoulder 55. The shoulder 55 thus prevents the insulator unit 7 from extending into the intermediate portion 57. The inner conductor 6 has a radial flange 60 which is formed at an intermediate section thereof and which is clamped between the inner and outer insulating rings 70, 71. The front end portion 51 further has a distal end which is formed with an inwardly projecting flange 56 to prevent the removal of the insulator unit 7 from the tubular outer conductor 5 via the front end portion 51.

Figure 6:
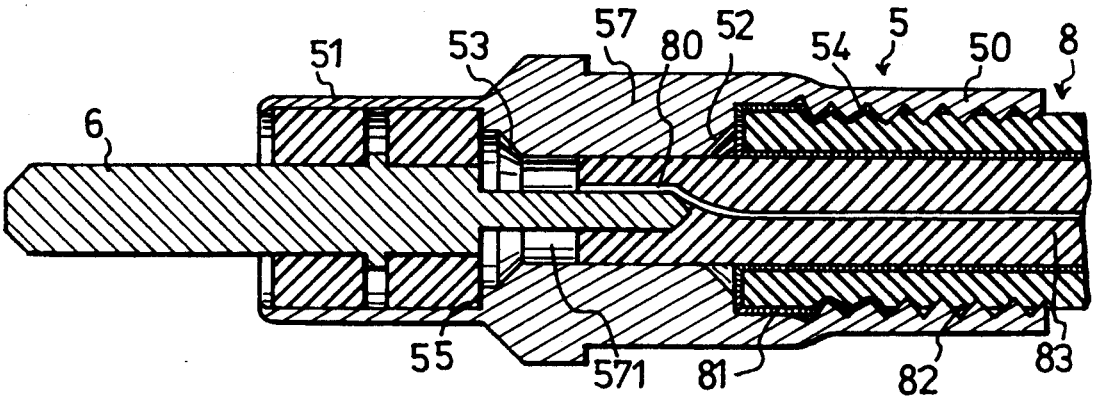
FIG. 6 is a sectional view illustrating the first preferred embodiment of a coaxial conductor which incorporates the coax connector shown in FIGS. 4 and 5.

Referring to FIG. 6, a coaxial signal cable 8 is shown to comprise a center conductor 80, a braided outer conductor 81, a dielectric 83 which separates the center conductor 80 from the braided outer conductor 81, and an insulating jacket 82 which is provided around the braided outer conductor 81. When mounting the coax connector on one end of the coaxial signal cable 8 to form a coaxial conductor of the present invention, it is necessary to strip one end of the insulating jacket 82 so as to expose a portion of the braided outer conductor 81. The exposed portion of the braided outer conductor 81 is then pulled over the insulating jacket 82 so as to expose a portion of the dielectric 83. The coaxial signal cable is then inserted into the tubular outer conductor 5 via the rear end portion 50 of the latter such that the exposed portion of the dielectric 83 extends slidably into the intermediate portion 57 so as to be pierced by the inner conductor 6 in order to establish electrical connection between the center conductor 80 and the coax connector. A crimping tool (not shown) is then employed so as to crimp the rear end portion 50 of the tubular outer conductor 5 onto the coaxial signal cable 8. At this stage, the teethed inner wall surface 54 of the rear end portion 50 penetrates into the insulating jacket 82 of the coaxial signal cable 8. Electrical contact between the tubular outer conductor 5 and the braided outer conductor 81 is established, and the structural connection between the coax connector and the coaxial signal cable 8 is strengthened at the same time.

Note that if portions of the braided outer conductor 81 were not crimped effectively by the teethed inner wall surface 54 of the rear end portion 50 of the tubular outer conductor 5, the diverging end section 52 of the through-hole 571 of the intermediate portion 57 can prevent said portions of the braided outer conductor 81 from extending into the latter, thereby preventing undesired contact between the braided outer conductor 81 and the inner conductor 6.

Figure 7:
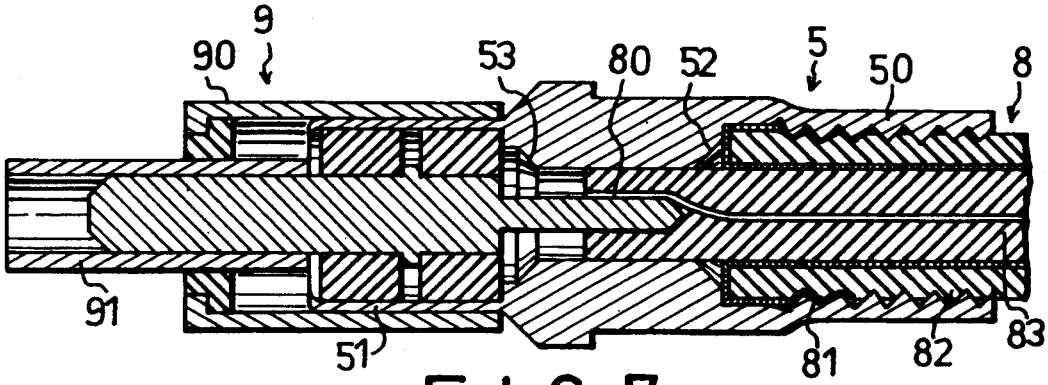
FIG. 7 is a sectional view illustrating the coaxial conductor of the first preferred embodiment when connected to a conventional socket.

Referring to FIG. 7, when the coax connector of the present invention is in use, the front end portion 51 of the tubular outer conductor 5 is inserted into a conventional socket 9 so as to achieve tight contact with an outer conductive sleeve 90 of the latter. The inner conductor 6 extends fittingly into an inner conductive sleeve 91 of the socket 9 at this stage, thereby establishing electrical connection between the coax connector and the socket 9.

Note that attachment of the coax connector to the coaxial signal cable 8 can be accomplished easily since there is no need to strip the dielectric 83 in order to establish electrical connection between the center conductor 80 and the inner conductor 6, as required in the prior art. The diverging end section 52 of the through-hole 571 of the intermediate portion 57 serves to guide the dielectric 83 into the latter. When the coaxial signal cable 8 is forced into the tubular outer conductor 5, the inner conductor 6 pierces into the dielectric 83 in order to establish electrical connection between the center conductor 80 and the coax connector. The rear end portion 50 of the tubular outer conductor 5 is crimped onto the coaxial signal cable 8 so that the teethed inner wall surface 54 of the rear end portion 50 penetrates into the insulating jacket 82 of the coaxial signal cable 8 to establish electrical connection between the tubular outer conductor 5 and the braided outer conductor 81 and to strengthen the structural connection between the coax connector and the coaxial signal cable 8, thereby completing the coaxial conductor of the present invention.

Because of the provision of the shoulder 55 and the inward flange 56, movement of the insulator unit 7 in the front end portion 51 of the tubular outer conductor 50 can be prevented. Thus, the inner conductor 6 can be prevented from extending further into the tubular outer conductor 5 if the coax connector was connected to the socket 9 improperly.

Figure 8:
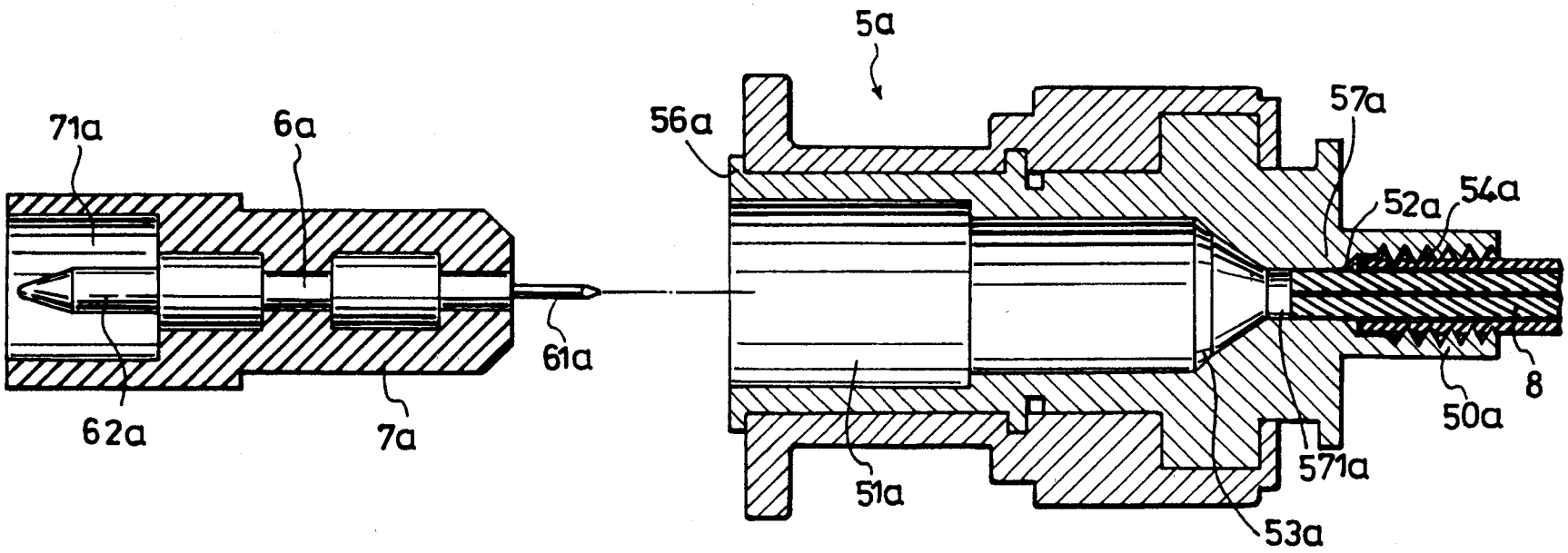
FIG. 8 is a partly exploded view of the second preferred embodiment of a coaxial conductor according to the present invention.

The coaxial conductor of the present invention should not be limited to one which incorporates a mini- DIN coax connector. Referring to FIG. 8, the second preferred embodiment of a coaxial conductor according to the present invention is shown to comprise an improved BNC coax connector with a tubular outer conductor 5*a* and a solid elongated inner conductor 6*a*. The tubular outer conductor 5*a* includes a rear end portion 50*a*, a front end portion 51*a* and an intermediate portion 57*a* which is disposed between the rear and front end portions 50*a*, 51*a* and which confines a through-hole 571*a* that communicates the rear and front end portions 50*a*, 51*a*. The through-hole 571*a* has a diameter that is smaller than the inner diameters of the rear and front end portions 50*a*, 51*a* and has two diverging end sections 52*a*, 53*a* that are disposed adjacent to a respective one of the rear and front end portions 50*a*, 51*a*. The rear end portion 50*a* has a teethed inner wall surface 54*a*.

The improved BNC coax connector further comprises an insulator unit 7*a* disposed fittingly in the front end portion 51*a*. The inner conductor 6*a* is a pin member with a predetermined length and is enclosed by the insulator unit 7*a*. The insulator unit 7*a* thus retains the inner conductor 6*a* in an axial direction of the tubular outer conductor 5*a*. The inner conductor 6*a* has a rear portion 61*a* that extends through the insulator unit 7*a* and into the intermediate portion 57*a* of the tubular outer conductor 5*a*. The insulator unit 7*a* further has a front end formed with a cavity 71*a* to permit access to the front portion 62*a* of the inner conductor 6*a*. In this embodiment, the diverging end section 53*a* of the through hole 571*a* prevents the insulator unit 7*a* from extending into the intermediate portion 57*a*. The front end portion 51*a* further has a distal end which is formed with a flange 56*a* that is to be folded inwardly to prevent the removal of the insulator unit 7*a* from the tubular outer conductor 5*a* via the front end portion 51*a*.

The connection between the coaxial signal cable 8 and the improved BNC coax connector of this embodiment is the same as that of the previous embodiment. The coaxial signal cable 8 is inserted into the tubular outer conductor 5*a* via the rear end portion 50*a* of the latter such that the exposed portion of the dielectric of the signal cable 8 extends slidably into the intermediate portion 57*a* so as to be pierced by the rear portion 61*a* of the inner conductor 6*a* in order to establish electrical connection between the center conductor of the signal cable 8 and the coax connector. A crimping tool (not shown) is then employed so as to crimp the rear end portion 50*a* of the tubular outer conductor 5*a* onto the coaxial signal cable 8. At this stage, the teethed inner wall surface 54*a* of the rear end portion 50*a* penetrates into the insulating jacket of the signal cable 8. Electrical contact between the tubular outer conductor 5*a* and the braided outer conductor is established, and the structural connection between the improved BNC coax connector and the coaxial signal cable 8 is strengthened at the same time.

While the present invention has been described in connection with what is considered the most practical and preferred embodiments, it is understood that this invention is not limited to the disclosed embodiments but is intended to cover various arrangements included within the spirit and scope of the broadest interpretation so as to encompass all such modifications and equivalent arrangements.

I claim:

1. A coax connector for a coaxial signal cable, comprising:

a tubular outer conductor having a rear end portion, a front end portion and an intermediate portion which is disposed between said rear and front end portions and which confines a through-hole void that communicates said rear and front end portions, said rear end portion having a teethed inner wall surface, said through-hole void having a diameter smaller than inner diameters of said rear and front end portions, and a first diverging end section adjacent to said rear end portion;

an insulator unit disposed fittingly to substantially span the inner diameter of said front end portion of said tubular outer conductor; and an elongated inner conductor having a portion that extends through said insulator unit and into the void of said intermediate portion of said tubular outer conductor, said inner conductor being retained in an axial direction of said tubular outer conductor by said insulator unit.

2. The coax connector as claimed in claim 1, wherein said through-hole has a second diverging end section adjacent to said front end portion.

3. The coax connector as claimed in claim 2, wherein said front end portion has a distal end which is formed with an inwardly projecting flange to prevent removal of said insulator unit from said tubular outer conductor via said front end portion.

4. A coaxial conductor comprising:

a coax connector including: a tubular outer conductor having a rear end portion, a front end portion and an intermediate portion which is disposed between said rear and front end portions and which confines a through-hole void that communicates said rear and front end portions, said rear end portion of said tubular outer conductor having a teethed inner wall surface, said through-hole void having a diameter smaller than inner diameters of said rear and front end portions, and a first diverging end section adjacent to said rear end portion; an insulator unit disposed fittingly to substantially span the inner diameter of said front end portion of said tubular outer conductor; and an elongated inner conductor having a portion that extends through said insulator unit and into the void of said intermediate portion of said tubular outer conductor, said inner conductor being retained in an axial direction of said tubular outer conductor by said insulator unit; and a coaxial signal cable including a center conductor, a braided outer conductor, a dielectric which separates said center conductor from said braided outer conductor, and an insulating jacket which is provided around said braided outer conductor, one end of said insulating jacket being stripped so as to expose a portion of said braided outer conductor, said exposed portion of said braided outer conductor being pulled over said insulating jacket so as to expose a portion of said dielectric, said coaxial signal cable being inserted into said tubular outer conductor via said rear end portion such that said exposed portion of said dielectric extends slidably into said intermediate portion void so as to be pierced by said inner conductor in order to establish electrical connection between said center conductor and said inner conductor, said rear end portion of said tubular outer conductor being crimped to permit said teethed inner wall surface to penetrate into said insulating jacket of said coaxial signal cable and to permit electrical contact between said braided outer conductor and said tubular outer conductor.

5. The coaxial conductor as claimed in claim 4, wherein said through-hole has a second diverging end section adjacent to said front end portion.

6. The coaxial conductor as claimed in claim 5, wherein said front end portion of said tubular outer conductor has a distal end which is formed with an inwardly projecting flange to prevent removal of said insulator unit from said tubular outer conductor via said front end portion.

* * * * *